US005824996A

United States Patent [19]

Kochman et al.

[11] Patent Number: 5,824,996

[45] Date of Patent: Oct. 20, 1998

[54] ELECTROCONDUCTIVE TEXTILE HEATING ELEMENT AND METHOD OF MANUFACTURE

[75] Inventors: Arkady Kochman, Mt. Prospect; Arthur Gurevich, Wilmette, both of Ill.

[73] Assignee: Thermosoft International Corp, Wilmette, Ill.

[21] Appl. No.: 855,595

[22] Filed: May 13, 1997

[51] Int. Cl.[6] ..... H05B 3/34; H01C 3/06

[52] U.S. Cl. ..... 219/529; 219/549; 338/211

[58] Field of Search ..... 219/211, 212, 219/527, 528, 529, 542, 543, 545, 548, 549; 338/210, 211, 212

[56] References Cited

U.S. PATENT DOCUMENTS

| | | | |
|---|---|---|---|
| 3,349,359 | 10/1967 | Morey | 219/545 |
| 3,385,959 | 5/1968 | Ames et al. | 219/549 |
| 3,657,516 | 4/1972 | Fujihara | 219/549 |
| 3,774,299 | 11/1973 | Sato et al. | 29/611 |
| 3,935,422 | 1/1976 | Barnes et al. | 219/543 |
| 4,149,066 | 4/1979 | Niibe . | |
| 4,250,397 | 2/1981 | Gray et al. | 219/528 |
| 4,309,596 | 1/1982 | Crowley . | |
| 4,538,054 | 8/1985 | de la Bretoniere . | |
| 4,764,665 | 8/1988 | Orban et al. . | |
| 4,825,049 | 4/1989 | Rickborn | 219/545 |
| 4,983,814 | 1/1991 | Ohgushi et al. | 219/545 |
| 5,023,433 | 6/1991 | Gordon | 219/548 |
| 5,068,518 | 11/1991 | Tasuda | 219/549 |
| 5,298,722 | 3/1994 | Tanaka | 219/545 |

*Primary Examiner*—Teresa J. Walberg
*Assistant Examiner*—Sam Paik
*Attorney, Agent, or Firm*—Longacre & White

[57] ABSTRACT

A soft and flexible thin heating element is made of strong, light and non-metallic yarns. The heating element comprises electrically conductive carbon/graphite containing fibers, woven or stranded into the strips, ropes, sleeves or strands of threads. The selected areas of the heating element core are modified to impart additional electrical properties. An optional positive temperature coefficient (PTC) material is incorporated into said selected areas. The electrode conductors are attached to said heating element core which is electrically connected in parallel or in series. The heating element core is shaped in a desired pattern. The whole assembly is sealed by at least one electrically insulating layer which envelops the strips, ropes, sleeves, or strands of threads.

56 Claims, 4 Drawing Sheets

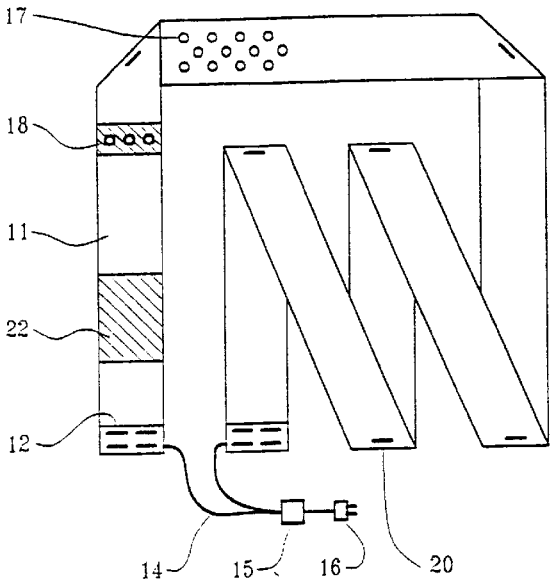
FIG. 1-A
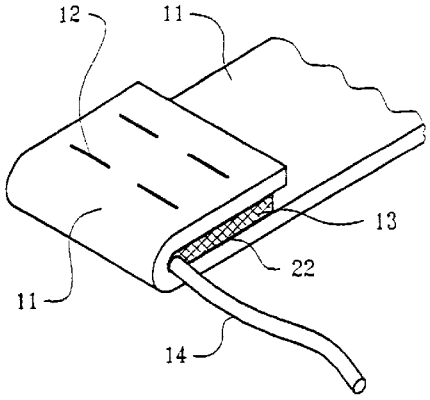
FIG. 1-B
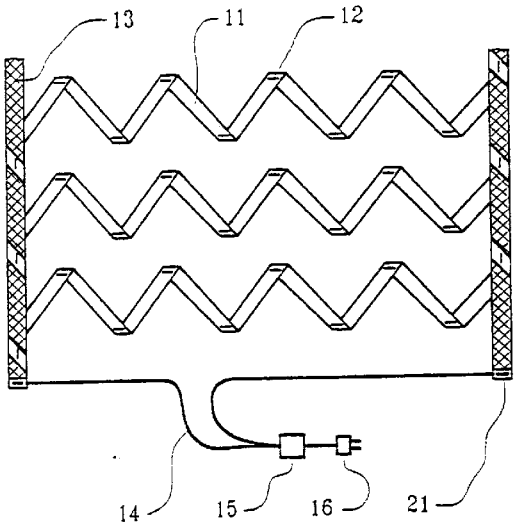
FIG. 2-A
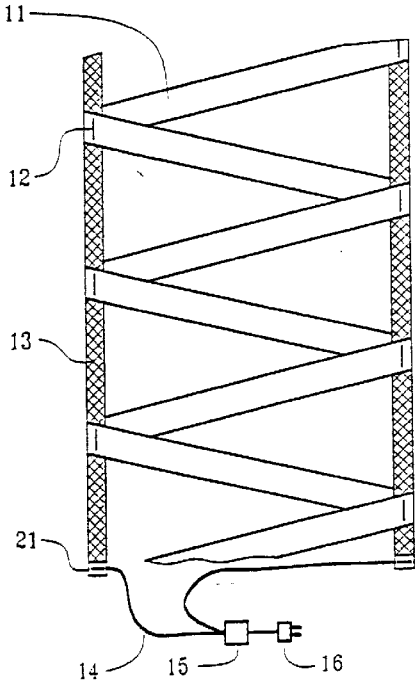
FIG. 2-B

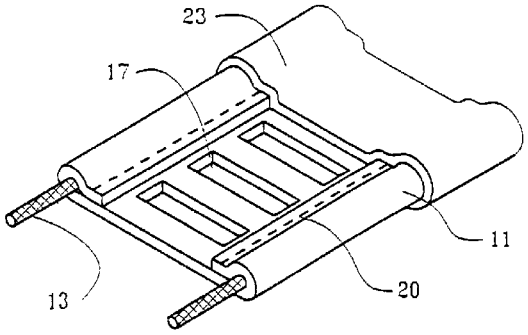
FIG. 3
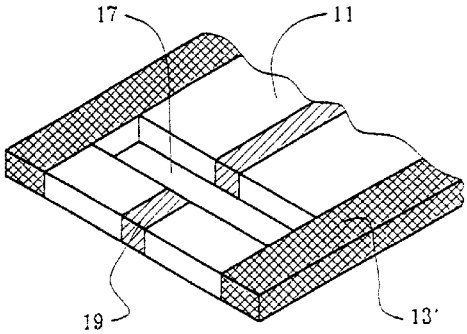
FIG. 4-A
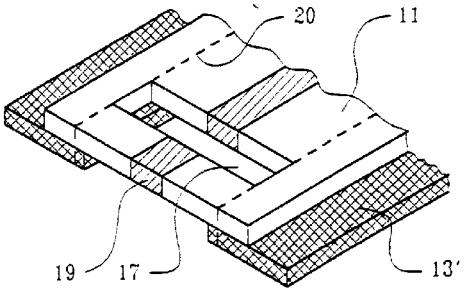
FIG. 4-B
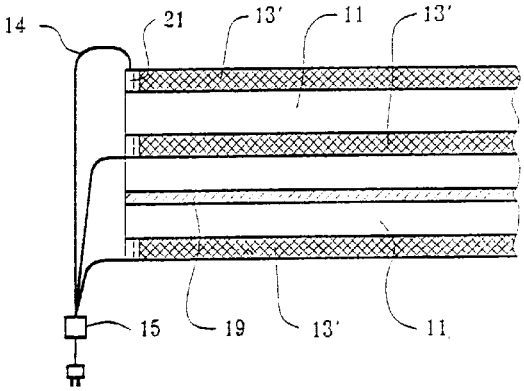
FIG. 5
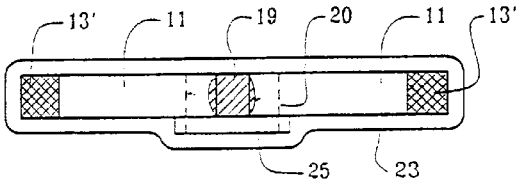
FIG. 6
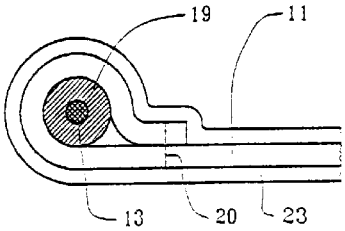
FIG. 7

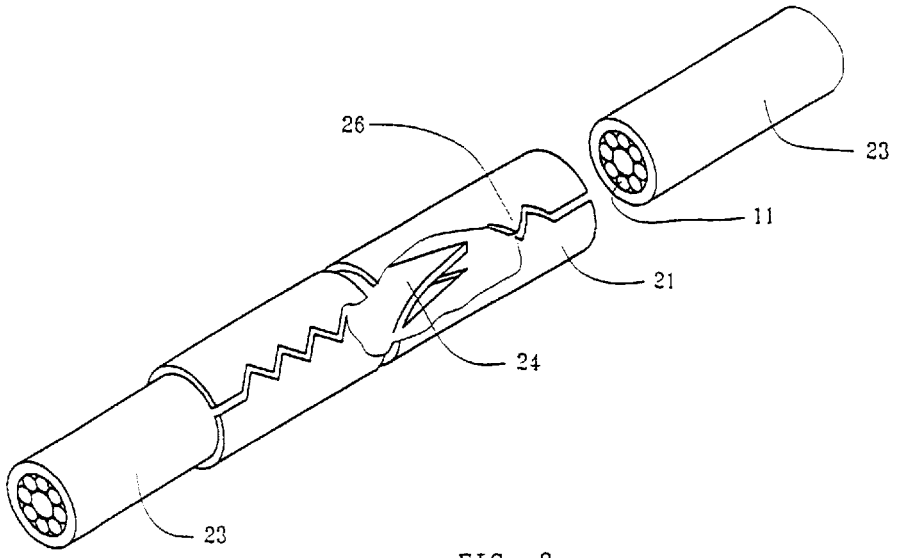
FIG. 8
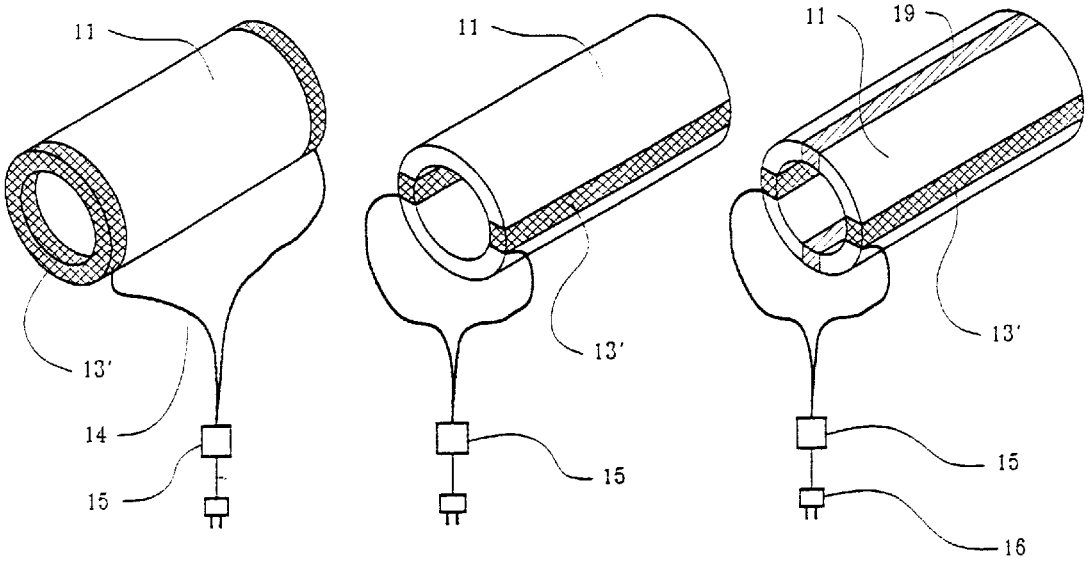
FIG. 9-A FIG. 9-B FIG. 9-C

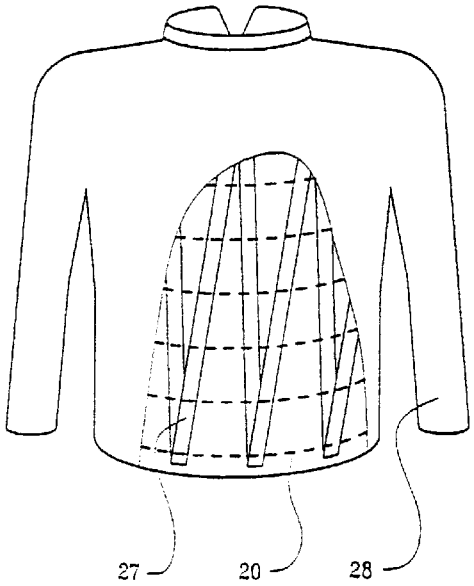
FIG. 10-A
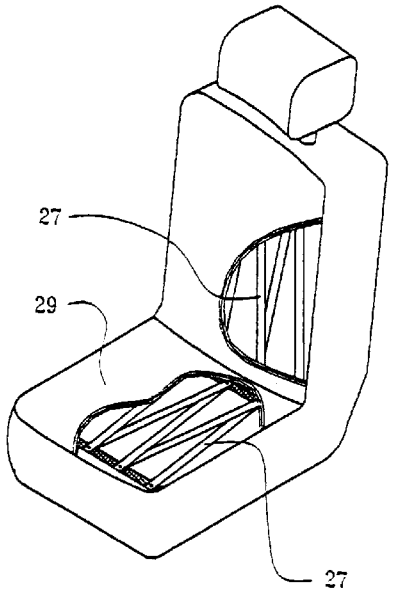
FIG. 10-B
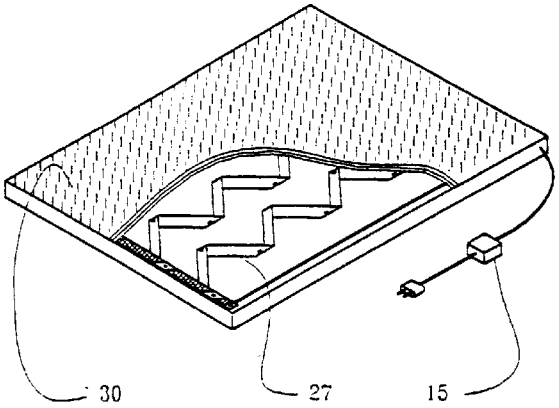
FIG. 10-C
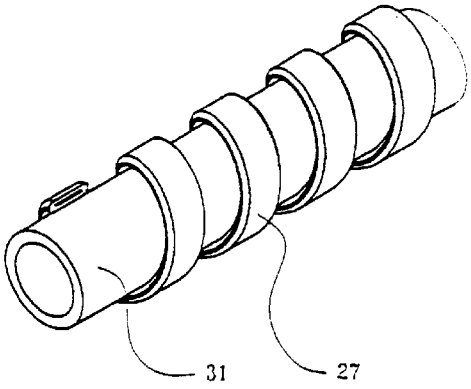
FIG. 10-D

ELECTROCONDUCTIVE TEXTILE HEATING ELEMENT AND METHOD OF MANUFACTURE

BACKGROUND OF THE INVENTION

1. Field of Invention

This invention relates to heating elements, and particularly to heating elements which have a soft, strong and light electrically conductive nonmetallic core.

2. Description of the Prior Art

Heating elements have extremely wide applications in household items, construction, industrial processes, etc. Their physical characteristics, such as thickness, shape, size, strength, flexibility and other characteristics affect their usability in various applications.

Numerous types of thin and flexible heating elements have been proposed, for example U.S. Pat. No. 4,764,665 to Orbat et.al. This heating element, however, is made of a solid piece of fabric with metallized coating, it does not allow for flexibility in selection of desired power density and is not economical due to metallizing process. The '665 design is also not conducive to hermetic sealing through the heater areas which can cause a short circuit through puncture and admission of liquid into the body of heating element. This element can't be used with higher temperatures due to the damage that would be caused to the metallized fabric. Another prior art example is U.S. Pat. No. 4,538,054 to de la Dorwerth. However, the heating element of de la Dorwerth '054 suffers from the following drawbacks: its manufacturing is complex requiring weaving of metal or carbon fibers into non-conductive fabric in a strictly controlled pattern; the use of the metal wire can result in breakage due to folding and crushing and it affects softness, weight and flexibility of the finished heater; it can't be manufactured in various shapes, only a rectangular shape is available; only perimeter sealing is possible, which can result in a short circuit due to puncture and admission of a liquid into the body of the heating element; the method of interweaving of wires and fibers doesn't result in a strong heating element, the individual wires can easily shift adversely affecting the heater durability; the fabric base of the heating element is flammable and may ignite as a result of a short circuit; it is not suitable for high temperature applications due to destruction of the insulating weaving fibers at temperatures exceeding 120° C.

Further, attempts have been made to fabricate electrically heated systems from carbon fibers, yarns, and fabrics by coating the carbon material with a protective layer of elastomer or other materials to overcome carbon's extremely poor abrasion and kink resistance (Carbon Fibers for Electrically Heated Systems, by David Mangelsdorf, final report 6/74–5/75, NTIS). It was found that the coating used in this method reduced the carbon material flexibility and increased the difficulty of making electrical attachments to it, and making electrically continuous seams. The poor flexibility of coated carbon fabric made this material unsuitable for small and complex assemblies, such as handware.

U.S. Pat. No. 4,149,066 to Niibe at. al describes a sheet-like thin flexible heater made with an electroconductive paint on a sheet of fabric. This method has the following disadvantages: the paint has a cracking potential as a result of sharp folding, crushing or punching; the element is hermetically sealed only around its perimeter, therefore lacking adequate wear and moisture resistance; such an element can't be used with high temperatures due to destruction of the underlying fabric and thermal decomposition of the polymerized binder in the paint; the assembly has 7 layers resulting in loss of flexibility and lack of softness.

Additionally, a known method of achieving a flexible flat heating element is by surfacing threads of fabric with carbon particles and various polymers as disclosed in U.S. Pat. No. 4,983,814. The resulting heating elements have necessary electrophysical characteristics, but their manufacturing is complex and is ecologically unfriendly because of the use of organic solvents, such as diethylphormamide, methylethylketone and others. Furthermore, this method involves application of an electroconductive layer only to the surface of threads of fabrics. This layer, electro-conductivity of which is achieved through surface contact of extremely small particles, is susceptible to damage due to external factors, such as friction, bending, etc.

A heating element proposed by Ohgushi (U.S. Pat. No. 4,983,814) is based on a proprietary electroconductive fibrous heating element produced by coating an electrically nonconductive core fiber with electroconductive polyurethane resin containing the carbonatious particles dispersed therein. Ohgushi's manufacturing process is complex; it utilizes solvents, cyanates and other very toxic substances. The resulting heating element has a temperature limit of 100° C. and results in a pliable but not soft heating element. In addition, polyurethane, used in Ohgushi's invention, when heated to high temperature, will decompose, releasing very toxic substances, such as products of isocyanide. As a consequence, such heating element must be hermetically sealed in order to prevent human exposure to toxic off-gassing.

Ohgushi claims temperature self limiting quality for his invention, however "activation" of this feature results in the destruction of the heater. Ohgushi proposes the use of the low melting point non-conductive polymer core for his conductive fabric heating element, which should melt prior to melting of the conductive layer, which uses the polyurethane binder with the melting point of 100° C. Thus, the heating element of Ohgushi's invention operates as a single use fuse and does not possess self-restoring quality of the positive temperature coefficient (PTC) materials.

Another prior art example is U.S. Pat. No. 4,309,596 to George C Crowley, describing a flexible self-limiting heating cable which comprises two conductor wires separated by a positive temperature coefficient (PTC) material. Said heating wires are disposed on strands of nonconductive fibers coated with conductive carbon. This method has the following disadvantages: (a) the wires are enveloped and separated by the tough PTC material which thickens and hardens the heating element (b) the distance between the wires is very limited, due to a nature of the PTC material having a high electrical resistance, this prevents manufacturing of heaters with large heat radiating surface; (c) the heater is limited only to one predetermined highest temperature level, therefore, this heating device is unable to bypass said temperature level when a quick heating at the highest temperature is needed.

The present invention seeks to alleviate the drawbacks of the prior art and describes the fabrication of nonmetallic yarn heating element which is economical to manufacture; doesn't pose environmental hazards; results in a soft, flexible, strong, thin, and light heating element core, suitable for even small and complex assemblies, such as handware. A significant advantage of the proposed invention is that it provides for fabrication of heating elements of various shapes and sizes with predetermined electrical characteristics; allows for a durable heater, resistant to kinks and abrasion, and whose electro physical properties are unaffected by application of pressure, sharp folding, small perforations, punctures and crushing.

SUMMARY OF THE INVENTION

The first objective of the invention is to provide a significantly safe and reliable heating element which can function properly after it has been subjected to sharp folding, kinks, small perforations, punctures or crushing, thereby solving problems associated with conventional flexible heating metal wires. In order to achieve the first objective, the electric heating element of the present invention is comprised of carbon/graphite electrically conductive yarns which possess the following characteristics: (a) high strength; (b) high strength-to-weight ratio; (c) high thermal and electrical conductivity; (d) very low coefficient of thermal expansion; (e) non-flammability; (f) softness. The heating element core described in this invention is comprised of continuous or electrically connected separate strips, sleeves, ropes or strands of carbon/graphite yarns, which radiate a uniform heat over the entire heating core surface.

A second objective of the invention is to provide maximum flexibility and softness of the heating element. In order to achieve the second objective, the electric heating element of the invention contains thin (0.05 to 5.0 mm, but preferably within the range of 0.1–2.0 mm) threads, which are woven or stranded into continuous or electrically connected strips, sleeves/pipes, ropes or bundles, then arranged and insulated to have gaps between the electrically conductive media. It is preferable that all insulation components of the heating element assembly are thin, soft and flexible materials.

A third objective of the invention is to provide for the uniform distribution of heat without overheating and hot spots, thereby solving the problem of overinsulation and energy efficiency. In order to achieve this objective, one side of the heating element may include a metallic foil or a metallized material to provide uniform heat distribution and heat reflection. It is also preferable that the soft heating elements of the invention are made without thick cushioning insulation, which slows down the heat delivery to the surface of the heating apparatus.

A forth objective of the invention is to provide for ease in the variation of heating power density, thereby solving a problem of manufacturing various heating devices with different electric power density requirements. In order to achieve the forth objective, the yarns in the heating element core are woven or stranded into strips, ropes, sleeves/pipes or bundles with predetermined width, density of weaving and thickness. It is preferable that the strips, sleeves/pipes, ropes or strands are made of combination of yarns with different electrical resistance and/or include electrically non-conductive high strength polymer or ceramic fibers.

A fifth objective of the invention is to provide for ease in manufacturing of the heating element core, thereby eliminating a problem of impregnation of the whole fabric with stabilizing or filling materials to enable cutting to a desired pattern. In order to achieve the fifth objective, all strips, sleeves/pipes, ropes and threads are woven or stranded into a desired stable shape prior to the heating element manufacturing.

A sixth objective of the invention is to provide a temperature self-limiting properties to the heating element core if dictated by the heater design thereby eliminating a need for thermostats. In order to achieve the sixth objective, the positive temperature coefficient (PTC) material is utilized in the selected areas of the heating element core.

The present invention comprises a heating element containing soft, strong and light nonmetallic yarns acting as conducting media. It is also highly resistant to punctures, cuts, small perforations, sharp folding and crushing. It can be manufactured in various shapes and sizes, and it can be designed for a wide range of parameters, such as input voltage, desired temperature range, desired power density, type of current (AC and DC) and method of electrical connection (parallel and in series). A heating element consists of electrically conductive carbon/graphite yarns woven or stranded into strips, ropes, sleeves/pipes or strands of threads.

The selected areas of the heating element core are conditioned to impart a variety of electrical properties in said core. The conditioning of the soft woven heating element core may include a positive temperature coefficient (PTC) material to impart temperature self-limiting properties. The heating element core is shaped by folding or assembling of said conductive media into a predetermined pattern. The electrodes are attached to said heating element core and are electrically connected in parallel or in series. The soft heating element core is sealed to form an assembly containing at least one electrically insulating layer which envelops each strip, rope, sleeve/pipe or strand of threads.

BRIEF DESCRIPTION OF THE DRAWINGS

FIG. 1-A. shows a plan view of the heating element core electrically connected in series according to the preferred embodiment of the present invention;

FIG. 1-B is a perspective view of the end of the heating element core showing connection of an electrode;

FIG. 2-A is a plan view of the heating element core electrically connected in parallel, where individual strips are shaped in zigzag pattern;

FIG. 2-B is a plan view of the heating element core electrically connected in parallel according to the preferred embodiment of the present invention;

FIG. 3 is a perspective view of the insulated heating element core electrically connected in parallel, having electrical busses wrapped by the heating element core material and utilizing cut outs;

FIG. 4-A is a perspective view of a fragment of the heating element core electrically connected in parallel, having electrical busses made of woven strips sewn or stapled to the heating element core and having PTC material incorporated longitudinally into said heating element core in selected areas.

FIG. 4-B is a perspective view of a fragment of the heating element core, electrically connected in parallel having electrical busses made of highly conductive threads or thin metal wires woven or sewn into its body and having PTC material incorporated longitudinally into said heating element core in selected areas;

FIG. 5. shows a plan view of the heating element core having three bus conductors and a PTC material incorporated longitudinally into the body of said heating element core so as to separate two of three busses according to the preferred embodiment of the present invention; said busses are connected to a power source through a power controller;

FIG. 6 shows a cross-section of the insulated heating element including separate fragments of the heating element core, having PTC material connecting said fragments and providing electrical continuity.

FIG. 7 shows a cross-section of the insulated heating element including fragment of the heating element core where the bus electrode is enveloped by the PTC material according to the preferred embodiment of the present invention.

FIG. 8. shows a perspective view of a fragment of the heating element core made of a strand or a rope of non-metallic fibers with varying electrical properties, having electrode connector attached to its end by crimping;

FIG. 9-A shows a perspective view of a sleeve/pipe shaped heating element core, having bus electrodes and electrically connected in series according to the preferred embodiment of the present invention;

FIG. 9-B shows a perspective view of a sleeve/pipe shaped heating element core, having bus electrodes and electrically connected in parallel according to the preferred embodiment of the present invention;

FIG. 9-C shows a perspective view of a sleeve/pipe shaped heating element core, having bus electrodes, electrically connected in parallel and having an optional PTC material incorporated into said heating element core according to the preferred embodiment of the present invention;

FIG. 10-A is a plan view of the back side of a garment including soft heating element according to the preferred embodiment of the present invention.

FIG. 10-B is a perspective view of a vehicle seat including soft heating element according to the preferred embodiment of the present invention.

FIG. 10-C is a perspective view of a floor assembly including soft heating element according to the preferred embodiment of the present invention.

FIG. 10-D is a perspective view of a fragment of pipe having the soft heating element wrapped around said pipe according to the preferred embodiment of the present invention.

DETAILED DESCRIPTION OF THE INVENTION

The invention consists of a non-metallic heating element core made by assembling yarns comprising carbon/graphite fibers. Said core is woven into various longitudinal forms during textile fabrication, such as strips, sleeves, pipes and ropes. It may also take a form of a strand of threads. The heating element core may, along with electrically conducting carbon/graphite fiber yarns, contain other, electrically non-conducting, yarns in various proportion and weaving patterns in order to augment its electrical resistance. Such yarns have at least one of the following contents:

1. Yarns made of carbon/graphite carrying fibers with similar electrical characteristics.
2. Yarns made of carbon/graphite carrying fibers with varying electrical characteristics.
3. Yarns, as indicated in 1 or 2 above, with addition of ceramic, including fiberglass, fibers.
4. Yarns, as indicated in 1 or 2 above, with addition of synthetic polymer fibers.
5. Yarns, as indicated in 1 or 2 above, with addition of ceramic fibers which were coated with a thin, up to 0.5 micron layer of carbon/graphite.

It is preferable that the yarns consist of continuous filament fibers.

The heating element core utilizes a woven product in its final form, therefore eliminating a step of treatment of the whole core material with stabilizing substances, prior to cutting of patterns, from the heating element manufacturing process.

FIG. 1-A shows a woven electroconductive heating element core (11) in a form of a strip, folded and patterned as dictated by the heating element design. Portions of the heating element core (11) may be conditioned in various locations to augment the electrical resistance of the finished product, such conditioning is performed by at least one of the following methods:

a. the use of electroconductive adhesive (22), preferably graphite based;

b. the use of non-electroconductive coating material (18), preferably having adhesive properties.

c. making of cut outs of various shapes and sizes (17)

In order to control overheating, at least one power control device (15) is placed along the length of the heating element core. The bends and folds along the length of the heating element core are attached by at least one of the following shape holding methods:

a. sewing (20) with electroconductive threads, preferably carbon fiber based, or sewing with non-conductive threads;

b. stapling (12);

c. gluing d. riveting e. fusing or sealing by insulating material during lamination of the heating element core.

As shown in FIG. 1-B the heating element core is energized through a power cord (14) which is connected to the heating element with electrodes (13), preferably having a flat shape, with large contact area. The electrodes are attached to the ends of the heating element core (11), conditioned with electroconductive adhesive (22), said ends are folded over in order to have contact with both sides of the electrodes (13), then the electrode assembly is finished by sewing, stapling, riveting, or using a toothed connector.

In addition to the electrodes, the power cord has the following attachments, shown in FIG. 1-A:

a. electrical plug (16)

b. optional power control device (15)

Depending on the end use of the heating element, the manufacturing process utilizes the following assembly operations in any sequence:

a. folding and shaping the core material into a predetermined shape;

b. attachment of the electrodes and the power cord;

c. laminating between the insulating material layers;

It is preferable to utilize a heat radiating layer on one side of the insulated heating element core if dictated by the heating element design; such heat radiating layer may be an aluminum foil or metallized polymer, electrically insulated from the electroconductive heating element core.

FIG. 2-A shows the heating element core (11) in a form of the strips, zigzagged by folding in order to vary the electrical resistance and wound around the parallel longitudinal electrodes (13). This enables the variation of the heating element's electrical resistance without varying the heating element core material. The ends of the strips (11) are attached to the electrical busses (13) by sewing (20), stapling (12) or riveting.

Electrode connectors (21) and a power cord (14) are attached to the ends of the parallel bus electrodes (13). The lamination of the assembly between layers of electrically insulating material follows the connection of the electrode connector (21) to the ends of the heating element core (11). In order to connect the electrodes after the lamination process, when dictated by the heating element design, the insulating layer(s) shall be either stripped at the points of connection or punctured by the electrode connector (21).

FIG. 2-B demonstrates a variation of the heating element shown in FIG. 2-A. However, instead of zigzagged strips (11), folded and disposed between the electrical bus electrodes (13), the strips (11) have a straight run and are wound around the parallel bus electrodes (13). The contact between the strip and the busses is conditioned with a localized use of conductive adhesive, preferably carbon/graphite based, then secured by stapling (12) and/or sewing through the strip and the bus. The run of the zigzag, the distance between the peaks, may vary even in the same heating element, thereby varying the finished element temperature density, as may be dictated by the heating element design.

FIG. 3 shows a heating element core (11) utilizing cut-outs (17) in order to: (a) achieve the variation of the electrical resistance (b) to provide for tight and hermetic lamination of the heating element core by fusing the insulating layers (23) through said cut outs. The cut outs (17) may also be filled with conductive carbon carrying substances such as positive temperature coefficient materials (PTC). The electrical bus electrodes (13) are disposed longitudinally on the heating element core. They are made of metal wire strands or woven non-metallic strips with low electrical resistance or combination thereof.

The high electrical resistance of the fabric of the heating element core (11) can be achieved through addition of threads with high electrical resistance during the fabric weaving process, and through making cut-outs (17) in the body of the heating element core. The electrodes (13) are wrapped with the woven heating element core (11) and sewn (20) with either conductive or non-conductive threads capable of withstanding the maximum heat generated by the heating element. Staples can also be used for this purpose.

It is preferable to apply a carbon/graphite carrying electroconductive adhesive to secure a good electrical contact between the bus electrodes (13) and the woven non-metallic heating element core (11). The heating element assembly is then followed by lamination with the insulating materials and attachment of the electrode connectors and power cord with an optional controller, to the bus electrodes (13).

FIGS. 4-A and 4-B show variations of the electrical busses designs and their attachments.

FIG. 4-A shows a detail of a heating element core (11), prior to lamination with insulating materials, having high conductivity threads or thin metal wires woven or sewn into the matrix of the heating element core (11) near its edges to form a parallel buss electrode assembly (13').

An optional positive temperature coefficient (PTC) material (19) may be incorporated longitudinally into the heating element core (11) in selected areas. Such areas have the yarns woven in such manner that the electrical resistance across said areas is lower than the resistance of adjacent areas of the woven heating element core (11).

As an example, in order to achieve lower electrical resistance of said selected areas, the weaving process shall, for such selected areas, use partially conductive or nonconductive yarns, such as ceramic or polymers. Further, the incorporated PTC material (19) introduces an additional self-limiting electrical conductivity to said selected areas of the heating element core (11). It is preferable to incorporate the PTC material longitudinally either in the center of the heating element core (11) or next to the longitudinal bus electrode assembly (13'). Generally, the PTC material is made of a polymer substance having electroconductive carbon-carrying filler.

FIG. 4-B shows a detail of a heating element core (11), prior to lamination with the insulating materials, with optional cut-outs (17), attached to woven strip bus electrode assembly (13') with low electrical resistance. Such an attachment is made by sewing (20), stapling or riveting. It is preferable to condition the place of said connection with electroconductive adhesive comprising carbon/graphite particles prior to attachment. An optional PTC material (19) may be utilized as described in FIG. 4-A.

FIG. 5 shows a fragment of the heating element, prior to lamination with insulating materials, having at least three bus electrodes or bus electrode assemblies (13') and having the PTC material (19) longitudinally disposed between one set of bus electrode assemblies (13'), said heating element is electrically connected in parallel. The preferred method consists of having no PTC material between one set of bus electrode assemblies and having PTC material (19) longitudinally disposed between another set of bus electrode assemblies (13').

All three bus electrode assemblies (13') are connected to one power source through a power controller (15). This setup enables quick gain in temperature by bypassing one bus electrode and a zone comprising the PTC material (19). When the desired temperature of the heated object is achieved, the electrical contact is switched to the bus electrode assemblies so as to provide the heater, by directing the current through the PTC material (19), with self-limiting temperature capabilities.

As an alternative a PTC material with the same or different temperature limit may be longitudinally disposed in the area indicated above as having no PTC material. This will provide for a heater with two, preferably different, temperature zones, each having the self-limiting temperature control capabilities. This method allows for a heating element with multiple temperature zones bordered by bus conductors.

As shown in FIG. 6 the heating element core may comprise two or more separate fragments of woven electroconductive material (11) containing bus electrode assemblies (13') and having the PTC material (19) connecting said fragments longitudinally and providing electrical continuity. The location of the PTC material is dictated by the heating element design.

The two adjacent fragments of said woven heating element core (11) having at least one bus electrode assembly (13') are first connected by sewing (20) to electrically non-conductive connection strip (25), leaving a gap of predetermined width between them. Said gap is then bridged with softened PTC material (19) so as to penetrate the matrix of the woven fabric of the fragments of the heating element core (11) at the edges. The sewn connection strip (25) provides desired mechanical strength; the PTC material (19) provides electrical continuity and desired self-limiting temperature control. An insulating layer (23) envelops the assembly; it may also be used for connecting said adjacent fragments of the heating element core (11) instead of the connection strip (25).

FIG. 7 shows an optional detail of the heating element core (11) attachment to a bus electrode (13). In this detail the bus electrode is embedded in the PTC material (19); the shape of the PTC material envelop (19) varies with the heating element design. The edge of the heating element core (11) is then wrapped around said bus electrode (13) and PTC material (19), and secured by sewing (20), stapling or riveting. The connection between the PTC material and heating element core may also be heat sealed or fused. The insulation layer (23) envelops the whole electroconductive assembly.

FIG. 8 shows a fragment of the insulated heating element core (11) comprising a strand of threads or a woven rope and a preferred embodiment of its connection with a metal electrode connector (21). The heating element core (11) consists of a strand or rope comprising electrically conductive carbon/graphite or carbon/graphite coated ceramic threads or combination thereof. The non-electroconductive ceramic or polymer threads or combination thereof may be included in the strand or the rope of said core in order to impart additional mechanical strength and electrical resistance.

The electroconductive core (11) is then enclosed by the insulating sleeve (23). Due to a softness of the heating element core (11), it is preferable to make the electrical connection with the metal electrode connector (21) by penetration of a thin part of the connector, having shape of a thin insert (24), such as a tooth, a screw or a needle, through a transverse cut of the insulated heating element core. After penetration of such thin electroconductive insert (24) into the body of the heating element core (11), the electrode connector (21) and the insulated heating element core are attached by crimping.

The sides of the electrode connector may also include teeth (26) which are shaped to penetrate into the body of the heating element core (11) by puncturing through the insulator (23) during crimping, thus providing additional electrical connection. The electrode connector (21) may be utilized to provide electrical continuity between two segments of said heating element core or to connect one segment of a power cord and a segment of said insulated heating element core. The same type of the electrical connection may be applied for the insulated strip, sleeve or pipe heating element core described in this invention.

Another variation of the electrode attachment, proposed in this invention, consists of stripping the insulation (23) from the ends of the insulated heating element core (11) and attaching the electrode connector (21) to said core by crimping. It is preferable to condition the ends of the threads with electroconductive adhesive before attaching the electrode connector. It is also preferable that electroconductive adhesive comprises carbon/graphite particles.

FIG. 9-A shows a perspective view of a sleeve/pipe shaped heating element core (11) having bus electrode assemblies (13'), electrically connected in series according to the preferred embodiment of the present invention;

FIG. 9-B describes a perspective view of a sleeve/pipe shaped heating element core (11) having longitudinal bus electrode assemblies (13'), electrically connected in parallel.

FIG. 9-C shows a perspective view of a sleeve/pipe shaped heating element core (11), electrically connected in parallel, having bus electrode assemblies (13') and an optional PTC material (19) incorporated longitudinally into said heating element core;

The installation of the bus electrode assemblies (13'), the PTC material (19) and lamination with insulating materials may be conducted as explained above for other types of heating elements. For devices designed to heat pipe-type objects, it is preferable to have one longitudinal cut in the described sleeve heating element core for ease of installation of the heating element on said pipe-type objects.

The proposed soft non-metallic heating elements may be utilized in a variety of commercial and industrial heater applications, using direct or alternating current. The main advantages of the heating elements are the high reliability and safety which are provided by the tightly sealed soft and durable electrically conductive yarns.

Further, the use of electrically conductive carbon/graphite fibers, non-conductive ceramic or polymer fibers in the heating element has the following additional advantages:

it enables manufacturing of thin, soft and uniform heaters without utilizing conventional metal heater wires;

it provides high durability of the heating appliances which can withstand sharp folding, small perforations, punctures and compression without decreasing of electrical operational capabilities;

it provides high tear and wear resistance owing to: (a) high strength of the conductive yarns and (b) tight hermetically enveloping around all electrically conductive media with strong insulating materials;

it provides for manufacturing of corrosion and erosion resistant heating element owing to: (a) high chemical inertness of the carbon/graphite and ceramic yarns, (b) hermetic polymer insulation of the whole heating element including connection electrodes and temperature control devices, for utilization in chemically aggressive industrial or marine environments;

it offers versatility of variation of the electrical conductivity of the heating element core owing to: (a) weaving or stranding of the electrically conductive carbon/graphite yarns to the predetermined width and thickness of the strips, sleeves, ropes or strands of threads; (b) weaving of the yarns to the predetermined density or type of weaving; (c) weaving or stranding of the carbon/graphite yarns having different electrical conductivity in one unit; (d) weaving or stranding of the carbon/graphite yarns with nonconductive ceramic and/or polymer threads or fibers. (e) making cut outs of different shapes to vary the electrical resistance of the heating element core; (f) incorporating conductive carbon/graphite coated ceramic fibers or threads;

it provides for saving of electric power consumption owing to: (a) installation of heat reflective layer and (b) possibility of placing the heating element with less cushioning and insulation closer to the human body or to the heated object;

it allows for manufacturing of heating element with electrical connection of electrically conductive strips, ropes, sleeves/pipes or strands in parallel or in series;

it overcomes the problem of overheated spots owing to (a) high heat radiating surface area of the heating element core, (b) uniform heat distribution by the heat reflective layer, preventing the possibility of skin burns or destruction of the insulating layers;

it provides for extremely low thermal expansion of the heating element owing to the nature of the carbon/graphite, polymer or yarns. This feature is extremely important for construction applications (Example:-concrete) or for multi-layer insulation with different thermal expansion properties;

it consists of a non-combustible electrically conductive carbon/graphite and carbon/graphite coated ceramic yarns which do not cause arcing while being cut or punctured during electrical operation;

it offers high degree of flexibility and/or softness of the heating appliances depending on the type and thickness of insulation; and it provides technological simplicity of manufacturing and assembling of said heating element.

Further, a combination of the electrically conductive carbon/graphite carrying woven yarns and PTC material allows to: (a) provide temperature self-limiting properties of the soft heating appliances, eliminating need for thermostats; (b) increase the distance between the bus electrodes, decreasing the risk of short circuit between said bus electrodes; (c) provide dissipation of an excess heat through the highly thermally conductive carbon/graphite fibers; (d) provide larger heat radiating area resulting in higher efficiency of the heater; (e) provide a barrier for liquid penetration to the parallel bus conductors in the event of puncturing the insulated heating element core.

The process of manufacturing of the insulated heating elements can be fully automated, it utilizes the commercially available non toxic, nonvolatile and inexpensive products. The insulated heating core can be manufactured in rolls or spools with subsequent cutting to desired sizes and further attachment of electric power cords and optional power control devices.

Further, the proposed heating elements can be utilized in, but not limited to: (a) electrically heated blankets, pads, mattresses, spread sheets and carpets; (b) wall, furniture, ceiling and floor electric heaters; (c) vehicle, scooter, motorcycle, boat and aircraft seat heaters; (d) electrically heated safety vests, garments, boots, gloves, hats and scuba diving suits; (e) food (Example:-pizza) delivery and sleeping bags; (f) refrigerator, road, roof and aircraft/helicopter wing/blade deicing systems, (g) pipe line, drum and tank electrical heaters, (h) electrical furnace igniters, etc. In addition to the heating application, the same carbon/graphite carrying heating element core may be utilized for an anti static protection.

FIG. 10-A shows a garment (28) utilizing one of the embodiments of the present invention in its construction to provide a desired degree of warmth. The soft heating element (27) is sewn (20) into the garment in a predetermined location.

FIG. 10-B shows a vehicle seat (29) utilizing one of the embodiment of the present invention. The heating element (27) is placed under the seat upholstery.

FIG. 10-C demonstrates a floor assembly (30) utilizing one of the embodiments of the present invention in its construction to provide a desired degree of radiant heat. The heating element (27) is placed under the floor covering. An optional power control device (15) can be utilized in any proposed heating element assembly.

FIG. 10-D shows a length of pipe (31) utilizing one of the embodiments of the proposed invention to provide a desired degree of heating. The heating element (27) is wrapped around the pipe.

The aforementioned description comprises different embodiments which should not be construed as limiting the scope of the invention but, as merely providing illustrations of some of the presently preferred embodiments of the invention. Additional contemplated embodiments include: (a) in addition to carbon/graphite yarns the heating element core may include other electrically conductive materials other than carbon, such as copper, nickel or tin containing materials; (b) heating element core may include yarns made of ceramic fibers, such as alumina, silica, boria, zirconia, chromia, magnesium, calcia, silicon carbide or combination thereof; (c) heating element core may comprise electrically conductive carbon/graphite coated ceramic fibers, such as alumina, silica, boria, zirconia, chromia, magnesium, calcia, silicon carbide or combination thereof; (d) the strips can be soaked in a diluted solution of adhesives and dried, to ease the hole cutting during manufacturing of the heating element core and augmentation of its electrical properties; (e) the heating element core may comprise the conductive strips, ropes, sleeves/pipes or threads, having different electrical resistance; (f) the heating element core may be formed into various patterns such as serpentine or other desired patterns, including ordinary straight, coil or "U" shaped forms; (g) the electric power cord can be directly attached to the conductive heating element core without the use of electrodes, it is preferable to utilize electrically conductive adhesive, conductive paint, conductive polymer, etc. to assure good electrical connection; (h) the conductive heating element core can be electrically insulated by the soft non-conductive fabrics or polymers by sewing, gluing, fusing etc., forming a soft multi-layer assembly; (i) the conductive soft heating element core can be electrically insulated by rigid non-conductive materials like ceramics, concrete, thick plastic, wood, etc.; (j) the shape holding means can be applied on any part of the heating element core;

While the foregoing invention has been shown and described with reference to a number of preferred embodiments, it will be understood by those possessing skill in the art that various changes and modifications may be made without departing from the spirit and scope of the invention.

We claim:

1. A heating element comprising:

electrically conductive nonmetallic yarns, including at least carbon fibers, assembled into a soft material of continuous longitudinal shape during textile fabrication; said soft material is cut to a predetermined length and laid out into a predetermined pattern;

a conductive means for introducing an electrical current to said soft material;

an insulating means for insulating said electrically conductive soft material with at least one layer of nonconductive means; and conditioned local spots for providing diversity and control of electrical resistance in selected areas of said soft material.

2. The heating element according to claim 1, wherein said conditioned local spots are the selected areas, filled with electrically conductive graphite carrying substance.

3. The heating element according to claim 1, wherein said conditioned local spots are the selected areas cut out of said electrically conductive soft material.

4. The heating element according to claim 1, wherein said conditioned local spots are the selected areas, filled with a nonvolatile, nonconductive organic substance.

5. The heating element according to claim 1, wherein said conditioned local spots are the selected areas, comprising a positive temperature coefficient material for providing temperature self limiting capabilities to said heating element.

6. A heating element comprising:

electrically conductive nonmetallic yarns, including at least carbon fibers, assembled into a soft material of continuous longitudinal shape during textile fabrication; said soft material is cut to a predetermined length and laid out into a predetermined pattern;

a conductive means for introducing an electrical current to said soft material;

an insulating means for insulating said electrically conductive soft material with at least one layer of nonconductive means; and at least two bus conductors, running through the full length of said element, at least one fragment of said heating element comprising positive temperature coefficient material and at least one fragment of woven electroconductive material, comprising carbon fiber yarns, disposed longitudinally between at least two of said bus conductors so that each one of said positive temperature coefficient material fragments directly connects to not more than one of said bus conductors.

7. The heating element according to claim 6 wherein said positive temperature coefficient material connects to said bus conductors by embedding said bus conductor in said positive temperature coefficient material.

8. A soft heating element having a durable construction for incorporation into a plurality of articles, said element comprising:

at least one continuous electrically conductive textile strip, including carbon yarns, incorporated longitudinally into said textile strip, said strip is cut to a desired length, folded and laid out in predetermined pattern to fit the area of said heating element, providing that said soft heating element comprises at least one gap between folded portions of at least one of said strips;

a conductive means for introducing an electrical current to said textile strip;

an insulating means for insulating said electrically conductive textile strip with at least one layer of nonconductive means.

9. The soft heating element according to claim 8, wherein said textile strip comprises polymer yarns.

10. The soft heating element according to claim 8, wherein said textile strip comprises ceramic fibers.

11. The soft heating element according to claim 8, wherein said textile strip comprises electrically conductive ceramic fibers having carbon containing coating.

12. The soft heating element according to claim 8, wherein said folding of the strip consists of wrapping around an electrode for introducing an electrical current to said textile strip.

13. The soft heating element according to claim 8, further including conditioned local spots for providing diversity and control of electrical resistance in selected areas of said textile strip.

14. The soft heating element according to claim 13, wherein said conditioned local spots are the selected areas, comprising electrically conductive carbon carrying material.

15. The soft heating element according to claim 13, wherein said conditioned local spots are the selected areas cut out of said electrically conductive textile strip.

16. The soft heating element according to claim 13, wherein said conditioned local spots are the selected areas, saturated with a nonvolatile, nonconductive organic substance.

17. The soft heating element according to claim 8, further including a shape holding means for connecting and holding said folded portions of said textile strips in the predetermined pattern.

18. The soft heating element according to claim 17, wherein said shape holding means comprises stapling.

19. The soft heating element according to claim 17, wherein said shape holding means comprises sewing.

20. The soft heating element according to claim 17, wherein said shape holding means comprises securing of said folded portions of said textile strip by fusing with polymer material.

21. The soft heating element according to claim 8, wherein said conductive means is electrically conductive graphite containing adhesive for electrically connecting said textile strip with electrical conductors.

22. The soft heating element according to claim 8, wherein said textile strip is laid out in a zigzag pattern, wound around at least two electrical bus conductors and electrically connected in parallel.

23. The soft heating element according to claim 8, further including a heat reflecting layer, placed on at least one side of said soft heating element, and electrically insulated from said textile strip and said conductive means.

24. A soft heating element having a durable construction for incorporation into a plurality of articles, said heating element comprising:

a plurality of continuous electrically conductive textile strips, including carbon containing yarns, incorporated longitudinally into said textile strips, said strips are cut to a desired length, laid out in a predetermined pattern to fit the area of said heating element, providing that said soft heating element comprises at least one gap between said strips;

strip bus conductors for introducing an electrical current to said textile strips;

an insulating means for insulating said electrically conductive textile strips and said bus conductors with at least one layer of nonconductive means.

25. The soft heating element according to claim 24, further including conditioned local spots, comprising electrically conductive carbon carrying material for providing diversity and control of electrical resistance in selected areas of said textile strip.

26. A soft heating element having a durable construction for incorporation into a plurality of articles, said heating element comprising:

at least one continuous electrically conductive nonmetallic textile strip, including ceramic fibers having carbon containing coating, incorporated as weft into said textile strip, said strip comprises conditioned local spots for providing diversity and control of electrical resistance;

a conductive means for introducing an electrical current to said textile strip;

an insulating means for insulating said electrically conductive nonmetallic textile strip with at least one layer of nonconductive means.

27. The soft heating element according to claim 26, wherein said textile strip comprises polymer fibers.

28. The soft heating element according to claim 26, wherein said textile strip comprises ceramic fibers.

29. The soft heating element according to claim 26, wherein said conditioned local spots are the selected areas cut out of said electrically conductive textile strip.

30. The soft heating element according to claim 26, wherein said conditioned local spots are the selected areas, saturated with a nonvolatile, nonconductive organic substance.

31. The soft heating element according to claim 26, wherein said conditioned local spots are the selected areas, saturated with electrically conductive carbon carrying substance.

32. The soft heating element according to claim 26, wherein said conditioned local spots are the selected areas, comprising a positive temperature coefficient material for providing temperature self limiting capabilities to said heating element.

33. The soft heating element according to claim 26, further including:

at least two bus conductors, running through the full length of said heating element, at least one selected area of said heating element comprising positive temperature coefficient material, at least one portion of said electroconductive textile strip, disposed longitudinally between at least two of said bus conductors, providing that each one portion of said positive temperature coefficient material directly connects to not more than one of said bus conductors.

34. The soft heating element according to claim 33, wherein said positive temperature coefficient material connects to said bus conductors by embedding said bus conductor in said positive temperature coefficient material.

35. The soft heating element according to claim 26, wherein said conductive means are thin strands, comprising metal, incorporated into the matrix of said textile strip to form bus electrode assembly.

36. The soft heating element according to claim 26, wherein said conductive means comprise at least two electrode conductors, having the edges of said textile strip folded around said electrode conductors.

37. The soft heating element according to claim 26, further including a heat reflecting layer, placed on at least one side of said heating element, and electrically insulated from said textile strip and said conductive means.

38. A soft heating element having a durable construction for incorporation into a plurality of articles, said element comprising:

electrically conductive textile sleeve of continuous cross-section, including electroconductive carbon containing fibers, said sleeve comprises conditioned local spots for providing diversity and control of electrical resistance;

a conductive means for introducing an electrical current to said textile sleeve;

an insulating means for insulating said electrically conductive textile sleeve with at least one layer of non-conductive means.

39. The soft heating element according to claim 38, wherein said textile sleeve further including nonconductive polymer fibers.

40. The soft heating element according to claim 38, wherein said textile sleeve further including nonconductive ceramic fibers.

41. The soft heating element according to claim 38, wherein said electrically conductive carbon containing fibers comprise graphite fibers.

42. The soft heating element according to claim 38, wherein said carbon containing fibers comprise electrically conductive ceramic fibers having carbon containing coating.

43. The soft heating element according to claim 38, wherein said conditioned local spots are the selected areas cut out of said electrically conductive textile sleeve.

44. The soft heating element according to claim 38, wherein said conditioned local spots are the selected areas, comprising a nonvolatile, nonconductive organic substance.

45. The soft heating element according to claim 38, wherein said conditioned local spots are the selected areas, comprising electrically conductive carbon carrying material.

46. The soft heating element according to claim 38, wherein said conditioned local spots are the selected areas, comprising a positive temperature coefficient material for providing temperature self limiting capabilities to said soft heating element.

47. The soft heating element according to claim 38, further including:

at least two bus conductors, running through the full length of said heating element, at least one selected area of said soft heating element comprising positive temperature coefficient material, at least one portion of said electroconductive textile sleeve, disposed longitudinally between at least two of said bus conductors, providing that each one portion of said positive temperature coefficient material directly connects to not more than one of said bus conductors.

48. The soft heating element according to claim 47, wherein said positive temperature coefficient material connects to said bus conductors by embedding said bus conductor in said positive temperature coefficient material.

49. An electrode connector for introducing an electrical current to a heating element, comprising electrically conductive textile encapsulated by at least one layer of insulating material, said electrode connector comprises at least one electrically conductive insert penetrating into the body of said heating element through a transverse cut through said insulated conductive textile.

50. A soft heating cable having a durable construction for incorporation into a plurality of articles, said heating cable comprising:

electroconductive carbon containing fibers, incorporated into continuous textile bundle, said bundle is encapsulated by at least one layer of insulating material, cut into desired length and terminated by two electrode connectors, providing that each of said connectors comprises an electrically conductive insert penetrating into the body of said heating cable through a transverse cut through said insulated textile bundle.

51. The soft heating cable according to claim 50, wherein said textile bundle is a rope.

52. The soft heating cable according to claim 50, wherein said textile bundle is a strand of threads.

53. The soft heating cable according to claim 50, wherein said textile bundle comprises ceramic fibers.

54. The soft heating cable according to claim 50, wherein said textile bundle comprises polymer fibers.

55. The soft heating cable according to claim 50, wherein said textile bundle comprises carbon yarns.

56. The soft heating cable according to claim 50 wherein said textile bundle comprises ceramic fibers having carbon containing coating.

* * * * *